US005332947A

United States Patent [19]

Theiss et al.

[11] Patent Number: 5,332,947

[45] Date of Patent: Jul. 26, 1994

[54] INTEGRAL POLEPIECE RF AMPLIFICATION TUBE FOR MILLIMETER WAVE FREQUENCIES

[75] Inventors: Alan J. Theiss, Redwood City; Douglas B. Lyon, San Carlos, both of Calif.

[73] Assignee: Litton Systems, Inc., Beverly Hills, Calif.

[21] Appl. No.: 882,298

[22] Filed: May 13, 1992

[51] Int. Cl.[5] ..... H01J 23/00

[52] U.S. Cl. ..... 315/3.5; 29/600; 315/39.3

[58] Field of Search ..... 315/3.5, 5.35, 5.39, 315/39.3; 29/600

[56] References Cited

U.S. PATENT DOCUMENTS

| | | | |
|---|---|---|---|
| 3,011,085 | 11/1961 | Caldwell, Jr. | 315/3.5 |
| 3,099,765 | 7/1963 | Meyerer | 315/39.3 X |
| 3,188,533 | 6/1965 | Bretting et al. | 315/3.5 X |
| 3,711,943 | 1/1973 | James | 315/3.5 X |
| 4,103,207 | 7/1983 | Chaffee | 315/3.5 |
| 4,409,519 | 10/1983 | Karp | 315/39.3 X |
| 4,578,620 | 3/1986 | James et al. | 315/39.3 X |
| 4,586,009 | 4/1986 | James | 315/3.5 X |
| 4,619,041 | 10/1986 | Davis et al. | 29/600 |
| 4,800,322 | 1/1989 | Symons | 315/5.39 |
| 4,931,694 | 6/1990 | Symons et al. | 315/3.5 |
| 4,931,695 | 6/1990 | Symons | 315/5.39 |

FOREIGN PATENT DOCUMENTS

| | | | |
|---|---|---|---|
| 1233065 | 1/1967 | Fed. Rep. of Germany | 315/39.3 |
| 742070 | 12/1955 | United Kingdom . | |
| 1048440 | 11/1966 | United Kingdom . | |
| 1053861 | 1/1967 | United Kingdom . | |
| 1140917 | 1/1969 | United Kingdom . | |

*Primary Examiner*—Tony M. Argenbright
*Attorney, Agent, or Firm*—Graham & James

[57] ABSTRACT

An integral polepiece RF amplification tube for amplifying a millimeter wave RF signal is provided which has a laminate structure comprising a plurality of magnetic and non-magnetic conductive plates which are alternatingly and integrally formed together. The tube has substantially planar surfaces, which permit the attachment of a heat sink thereto. The non-magnetic plates each have a slot which provides a resonant cavity, and a portion of the magnetic plates have a notch which couples the cavities. A magnetic field induced into the tube provides focusing to an electron beam projected through a tunnel which passes through each of the cavities. The amplification tube can be configured for use as a coupled cavity traveling wave tube or a klystron.

35 Claims, 2 Drawing Sheets

10
14
16
18
22
24
26
28
34
42
44
46
52
54
161
162
163
32
5

INTEGRAL POLEPIECE RF AMPLIFICATION TUBE FOR MILLIMETER WAVE FREQUENCIES

BACKGROUND OF THE INVENTION

1. Field of the Invention

The present invention relates to microwave amplification tubes, such as traveling wave tubes or klystrons, and more particularly, to an integral polepiece RF amplification tube for amplifying microwave signals in the millimeter wavelength range.

2. Description of Related Art

Microwave amplification tubes, such as traveling wave tubes (TWTs) or klystrons, are well known in the art. These microwave tubes, are provided to increase the gain, or amplify, an RF (radio frequency) signal in the microwave frequency range. A coupled cavity TWT typically has a series of tuned cavities which are linked or coupled by irises formed between the cavities. A microwave RF signal induced into the tube propagates through the tube, passing through each of the coupled cavities. A typical coupled cavity TWT may have up to thirty individual cavities which are coupled in this manner. The meandering path which the RF signal takes as it passes through the tube reduces the effective speed of the traveling signal so that it can be operated upon. The reduced velocity wave formed by a coupled cavity tube of this type is known as a "slow wave."

Each of the cavities is further linked by a beam tunnel which extends the length of the tube. To produce an amplified RF output signal, an electron beam must be projected through the beam tunnel. The beam is guided by magnetic fields which are formed in the tunnel region. The electron beam will interact with the RF signal to produce the desired amplification. The bandwidth of frequencies of the resulting RF output signal can be changed by altering the dimensions of the cavities, and the strength of the RF output signal can be changed by altering the voltage and current of the beam.

An RF amplification tube can either utilize an "integral polepiece" or a "slip-on polepiece." The polepiece is typically made of magnetic material, which channels magnetic flux to the beam tunnel. An integral polepiece forms part of the vacuum envelope extending inward towards the beam region, while a slip-on polepiece lies completely outside the vacuum envelope of the tube.

The magnetic field which is induced in the tunnel region is obtained from flux lines which flow radially through the polepieces from magnets lying outside the tube region. This type of electron beam focusing is known as Periodic Permanent Magnet (PPM) focusing. When the polepieces form part of the tunnel as well as the cavity wall, the magnetic flux in the beam region can result in large beam stiffness values, or $\lambda_p/L$, a desirable condition for focusing beams. For this reason, integral polepiece RF amplification tubes are preferred over slip-on polepiece tubes.

Klystrons are similar to coupled cavity TWTs in that they can comprise a number of cavities through which an electron beam is projected. The klystron amplifies the modulation on the electron beam to produce a highly bunched beam containing an RF current. A klystron differs from a coupled cavity TWT in that the cavities are not generally coupled. However, a portion of the klystron cavities may be coupled so that more than one cavity can interact with the electron beam. This particular type of klystron is known as an extended interaction output circuit.

A significant problem with RF amplification tubes is the efficient removal of heat. As the electron beam drifts through the tube cavities, heat energy resulting from stray electrons intercepting the tunnel walls must be removed from the tube to prevent reluctance changes in the magnetic material, thermal deformation of the cavity surfaces, or melting of the tunnel wall. To remove the heat, copper plates are usually joined to the portion of the magnetic material that conducts the heat to the heat sink. This copper lowers the thermal resistance of the heat path and more easily keeps the tunnel temperature below dangerous levels. The minimum thermal path length in typical cylindrical cavities is the radius of the cavity.

An additional problem with RF amplification tubes is that it becomes more difficult to construct them to amplify RF signals in the millimeter wavelength range of the microwave spectrum, or millimeter waves. These extremely short wavelength signals require precise tolerances in the formation of the cavities and the coupling irises. It is well known that in a periodic microwave structure, an increase in the period-by-period variation of the inside dimensions, (those seen by the RF fields), will result in an increase of RF reflections inside the tube. This, in turn, results in degraded impedance matches between the tube and the RF input waveguide, and lower periodicity values than would otherwise exist. These factors result in reduced gain values achievable by the tube. Thus, as the nominal dimensions of parts decrease with the higher frequencies, the size of the period-by-period variations must also decrease.

In prior art integral polepiece RF amplification tubes, magnetic and non-magnetic parts are usually machined individually, stacked, then brazed together. In tubes designed to operate at millimeter wavelengths, the period-by-period dimension variations are often determined not only by the tolerances called out for the individual parts, but also by non-uniformities of the braze regions between the parts. At higher frequencies, where more periods and hence more parts are usually required, it becomes more difficult or costly to avoid tolerance build-up along the stack, especially if copper plates must be added to the polepieces to improve the thermal conductivity along the cavity wall.

Consequently, integral polepiece RF amplification tubes become less useful as the operating frequencies and the number of parts increase. More often, the tube is machined out of a single block of copper using discharge machining technique to control the dimension variation problem. Afterwards, a separate magnetic circuit is slipped on and brazed to the tube if light weight PPM focusing is desired. However, by eliminating the integral polepiece, and the consequent introduction of magnetic flux at the tunnel wall, the desirable focusing property of integral polepiece RF amplification tubes has been lost. The ratio of $\lambda_p/L$ is significantly reduced, and only higher beam voltages can be focused.

Thus, it would be desirable to provide an integral polepiece RF amplification tube for amplifying a millimeter wave RF signal having polepieces extending fully, or at least partially, to the tunnel wall to provide desirable beam focusing. It would also be desirable to provide an integral polepiece RF amplification tube having copper plates in contact with the polepieces along the cavity wall to improve heat removal from the tunnel wall. It would be further desirable to provide a relatively inexpensive method of fabricating an integral polepiece RF amplification tube having the aforementioned features and which eliminates the deleterious effects of tolerance build-up.

SUMMARY OF THE INVENTION

Accordingly, a principal object of the present invention is to provide an integral polepiece RF amplification tube which amplifies a millimeter wave RF signal, and which has polepieces extending to the tunnel wall for improved beam focusing.

Another object of the present invention is to provide an integral polepiece RF amplification tube which amplifies a millimeter wave RF signal, and which has copper plates in contact with the polepieces along the cavity wall to improve thermal ruggedness and minimize thermal deformation of the cavity surfaces, reluctance variation of the magnetic material and melting of the tunnel wall which could result from high temperature operation.

Yet another object of the present invention is to provide a low cost method for making an integral polepiece RF amplification tube which eliminates the deleterious effects of tolerance build-up.

In accomplishing these and other objects, there is provided an RF amplification tube having a laminate structure comprising a plurality of magnetic and non-magnetic plates which are alternatingly and integrally formed together. The structure has substantially planar external surfaces and an internal beam tunnel. A plurality of magnets are provided which form a magnetic field having lines of flux flowing first through the magnetic plates then into the tunnel. The planar surfaces are provided on edges of the structure, and allow for the attachment of planar boundary heat sinks to the circuit. The non-magnetic plates each have one or more slots which provides a resonant cavity after attachment of the heat sinks. The beam tunnel extends through each of the magnetic plates and passes through each of the cavities, permitting projection of an electron beam therethrough. The use of planar configuration would be compatible with the goal of low cost construction, while achieving the needed geometry for the RF amplification. The non-magnetic plates contributes to removal of heat from the structure.

In a first embodiment of the present invention, a portion of the magnetic plates would be provided with a notch, and the notches couple the cavities. The position of the notches would alternate between a first edge coinciding with a first planar surface, and a second edge coinciding with a second planar surface which is opposite to the first planar surface. Alternatively, the position of the notches would all coincide with a single planar surface. A combination between the first and second alternatives is also possible, having a first portion of the notches coincide with the first planar surface, and a second portion of the notches coincident with the second planar surface. In these various embodiments of the present invention, the RF amplification tube would comprise a coupled cavity traveling wave tube.

In a second embodiment of the present invention, the notches would not be present and the cavities would remain uncoupled. In this embodiment, the RF amplification tube would comprise a klystron.

A method for manufacturing an RF amplification tube in accordance with the present invention first comprises the step of alternatingly assembling a plurality of magnetic and non-magnetic plates together into an integrally formed laminate structure. Notches can be cut into selected ones of the magnetic plates which partially extends into the adjacent non-magnetic plates. The selected edge can either alternate between a first side of the structure and a second side which is opposite to the first side, or can lie entirely along one side. Then, one or more slots are cut through selected ones of the non-magnetic plates. The slots provide the tuned cavities, and the notches couple the cavities once a planar heat sink is provided on the side or sides of the structure. A more complete understanding of the integral polepiece RF amplification tube for millimeter wave frequencies of the present invention will be afforded to those skilled in the art, as well as a realization of additional advantages and objects thereof, by a consideration of the following detailed description of the preferred embodiment. Reference will be made to the appended sheets of drawings which will be first described briefly.

DESCRIPTION OF THE PREFERRED EMBODIMENTS

Figure 1:
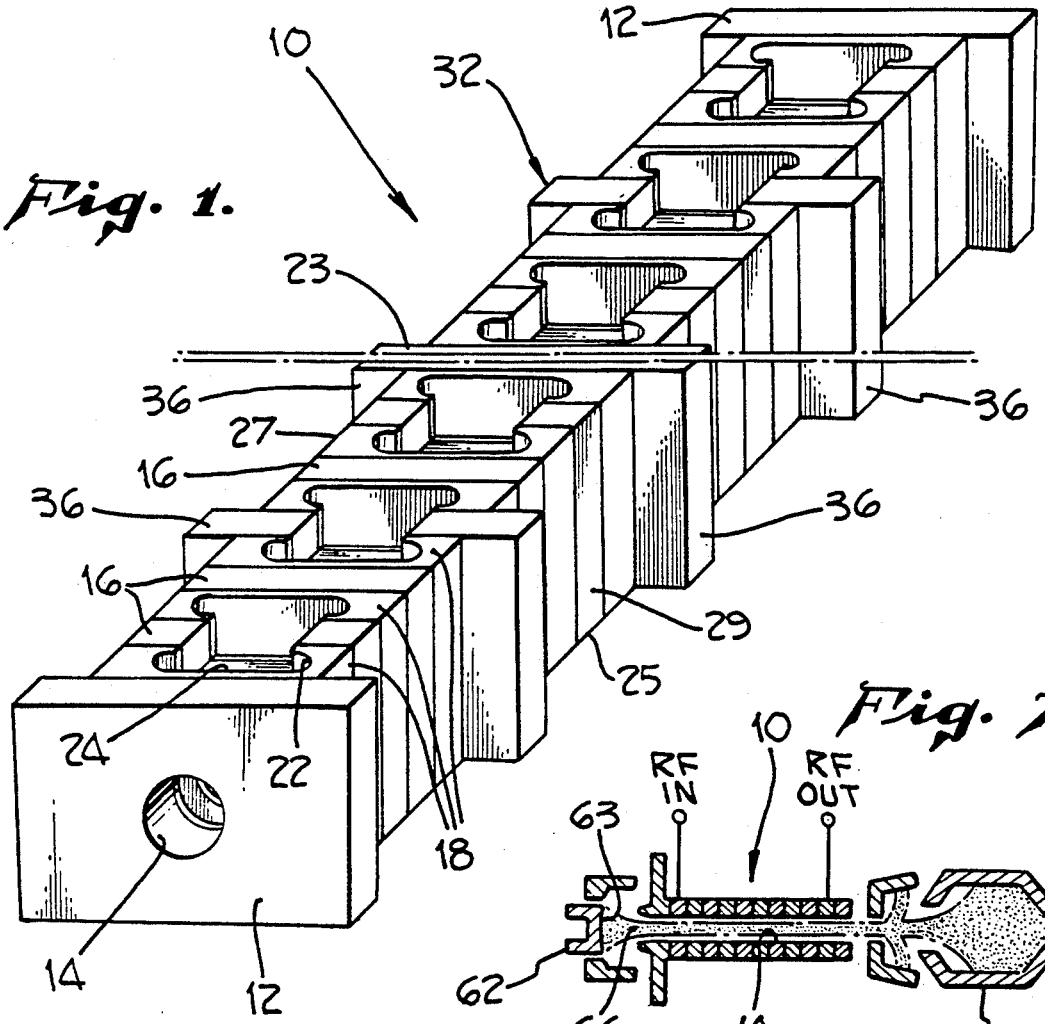
FIG. 1 is a perspective view of an integral polepiece RF amplification tube of the present invention.
Figures 2, 3, 4, 6:
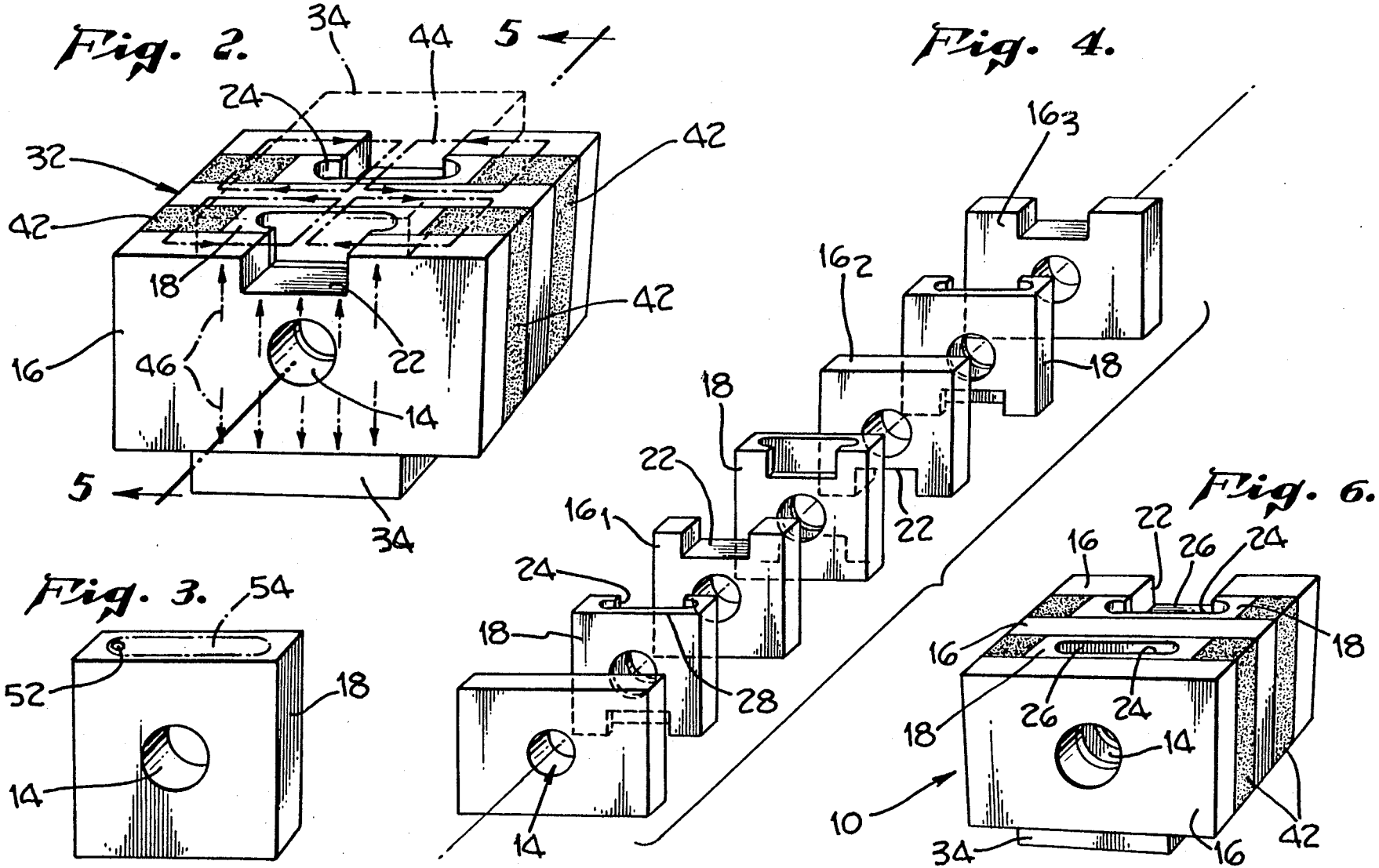
FIG. 2 is a partial perspective view of the integral polepiece RF amplification tube with the magnetic flux lines and the heat flux lines illustrated.
FIG. 3 is a perspective view of an unassembled, non-magnetic plate with an exposed pilot hole.
FIG. 4 is an exploded view of the integral polepiece RF amplification tube of FIG. 1.
FIG. 6 is a partial perspective view of an integral polepiece RF amplification tube for klystron operation.

Referring first to FIGS. 1 and 4, there is shown an RF amplification tube 10 according to the present invention. The tube 10 is formed from a laminate structure comprising a plurality of non-magnetic plates 18 and magnetic plates 16 which are alternatingly assembled and integrally formed together. The assembled tube 10 is elongated and generally rectangular, having end plates 12 disposed on either end, a first side 23, a second side 25 opposite the first side 23, a third side 27 and a fourth side 29 opposite the third side 27. As will be further described below, an electron beam provided in one end of the tube 10 would travel through a plurality of cavities formed within the TWT, and exit from an opposite end of the TWT.

Each of the magnetic plates 16 and non-magnetic plates 18 are generally rectangular. The preferred material for the magnetic plates 16 is iron. The magnetic plates 16, also known as polepieces, have a notch 22 disposed at an edge. The notch 22 shown in the drawings is generally rectangular, and extends less than halfway through the width of the polepiece. However, it is anticipated that alternative notch shapes, such as circular, be advantageously used.

The notch position for each polepiece 16 could alternate between the edge corresponding with the first side 23 and the edge corresponding with the second side 25.

As best shown in FIG. 4, the position of the notch 22 in polepiece $16_1$ appears at the first side 23. The next polepiece $16_2$ has a notch 22 disposed at the second side 25. The third polepiece $16_3$ would again feature the notch 22 at the first side 23, similar to that of polepiece $16_1$. Alternatively, the notch positions could all remain on a single side of the TWT 10, or could be a combination of the two configurations having a portion of the notches 22 disposed at the first side 23 and a portion disposed on the second side 25. In yet another embodiment, a single polepiece 16 could have more than one notch 22, such as one at both ends of the polepiece. As will be further described below, these notches will provide a coupling path for the neighboring cavities.

The non-magnetic plates 18 are adjacently positioned relative the polepieces 16, and alternate with the polepieces. The preferred material for the non-magnetic plates 18 is copper. Each of the non-magnetic plates 18 has one or more internal slots 24. Each slot 24 has a generally parallelepiped shape, which extends fully through the plate 18 from the first edge 23 to the second edge 25. The slot 24 shape could also be oval in cross-section. Alternatively, the slot 24 could extend between the third side 27 and the fourth side 29. The slot direction could also alternate between a first direction extending between the first and second sides 23 and 25, and a second direction extending between sides 27 and 29. These slots 24 provide a tuned cavity 26.

Figure 5:
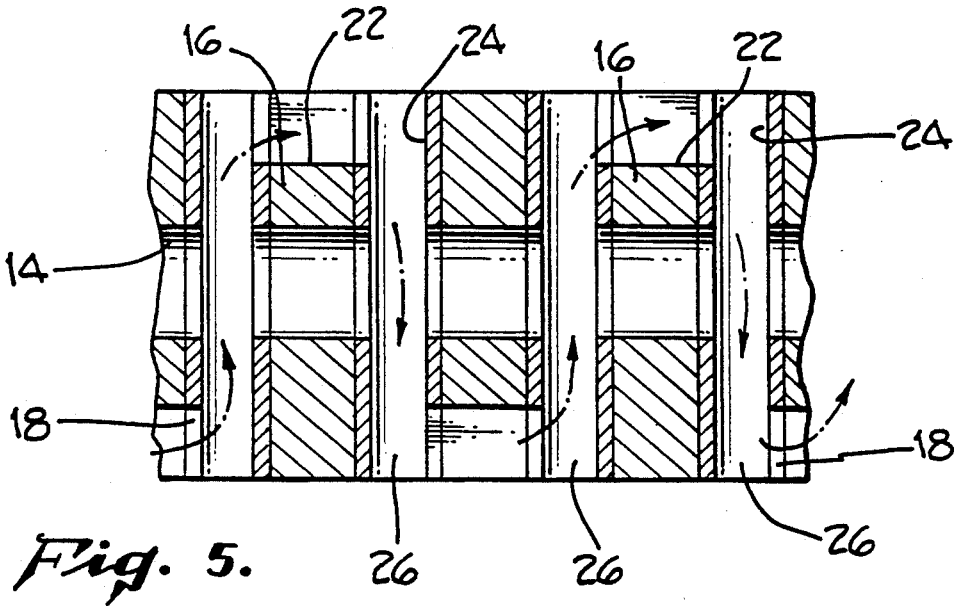
FIG. 5 is a cross-sectional view of the interior of the integral polepiece RF amplification tube, as taken through the Section 5—5 of FIG. 2.

It should be apparent from FIG. 4 that with the alternating polepieces 16 and non-magnetic plates 18 integrally formed together, there would be a continuous path through the tube 10 that extends through each cavity and crosses over each notch into an adjacent cavity. This path is also visible in the sectional drawing of FIG. 5.

Extending fully lengthwise through the tube 10 is an electron beam tunnel 14. The tunnel 14 is generally circular in shape and passes through each of the cavities 26, further linking the cavities. The beam tunnel provides a path for the projection of an electron beam through the completed coupled cavity tube 10. With the cavities 26 coupled by the notches 22 as described above, the tube 10 would function as a coupled cavity traveling wave tube amplifier. In operation, the electron beam interacts with an RF signal passing through the coupled cavities. Energy from the beam transfers to the RF signal, to increase the power of the RF signal.

Each of the polepieces 16 and the non-magnetic plates 18 have edges which are flush with the first side 23 and the second side 25. As will be further described below, the first side 23 and the second side 25 provide a planar surface 32, 32' for attachment of a heat sink 34. The third side 27 and fourth side 29 are flush with the other edges of each of the non-magnetic plates 18 and some of the polepieces 16. However, individual ones of the polepieces 16 extend outward from the third side 27 and the fourth side 29 to provide ears 36. The combination of the flush surface 38 and the ears 36 provide a mounting position 38 for the installation of magnets 42. The magnets 42 as shown in FIG. 2 are substantially rectangular. However, other shapes of magnets, such as cylindrical, can be advantageously used.

As shown in FIG. 2, the magnets 42 are disposed within the mounting positions 38 relative the TWT 10 so as to provide a magnetic field having flux lines 44 through the polepieces 16. The flux lines extend through the polepieces 16, jump across the non-magnetic plates 18 into the adjacent polepiece 16. The flux lines 44 also cross through the beam tunnel 14, to provide focusing for the electron beam. The magnetic flux lines 44 then jump across the space formed by the notch 22, back through the adjacent cavity 26 and into the first polepiece 16. It should be apparent that the heat sink surface 32 can be moved closer to the tunnel 14 by changing the shape of the slots 24 and the notches 22, therefore improving still further the heat handling ability of the tube 10.

Referring now to FIG. 6, there is an alternative embodiment in which the tube 10 can provide klystron operation. A portion of the magnetic plates 16 are provided without notches. As the electron beam passes through the tube 10, an electromagnetic field is formed within the cavities 26 which produces an RF signal. As known in the art, a portion of the cavities 26 can be coupled by the notches 22 to operate as an extended interaction output circuit for improved bandwidth.

To assemble an RF amplification tube 10 of the present invention, a laminate structure of generally rectangular, magnetic, and non-magnetic plates must be formed. Each of the magnetic and non-magnetic plates has a center alignment hole. A thin-walled moly tube is inserted through each of the alignment holes, so that the alternating plates can be aligned together. Once the plates are assembled they are integrally formed together into the laminate structure by brazing or other joining technique. Each of the non-magnetic plates further has a pilot hole 52 extending from the edge associated with the first side 23 to the edge associated with the second side 25. An exemplary pilot hole 52 in an unassembled non-magnetic plate 18 is shown in FIG. 3. Once the structure of magnetic and non-magnetic plates are brazed together into an integral unit, the pilot holes 52 extend through a width of the structure and provide a mechanism for cutting out the cavities, as will be further described below.

The next step is to reduce the exposed edges of the rectangular tube 10 into an approximate shape. It is anticipated that this be done through conventional milling techniques. Once the sides are squared off, the desired notches 22 are cut into the sides 23 and 25. The notches extend entirely across the width of the polepieces 16 and partially extend into each adjacent non-magnetic plate 18. As known in the art, the preferred cutting technique is dependent on the desired tolerance requirement.

After the notches 22 are formed, the cavities 26 can be cut out. The preferred method of cutting the cavities 26 is by using wire electron discharge machining (EDM). Under this technique, a wire is fed through the pilot holes 52 to cut away the undesired copper material, leaving the slot 24 without cutting through the cavity wall. This step is repeated to form each of the cavities 26 in the tube 10. After the cavities 26 are formed, a continuous path would result from the notches 22 which join the cavities 26.

The wire EDM technique is then used to square off the first side 23 and the second side 25, providing the heat sink surfaces 32, 32'. The wire EDM technique can also be used to remove side portions of the polepieces 16 and non-magnetic plates 18, leaving only the exposed ears 36. As desired, this last step can be performed to leave ears every three polepieces as shown in FIG. 1, or every two polepieces, as shown in FIG. 2. The moly tube is also removed by the wire EDM technique, and the tool used to form the electron beam tunnel 14.

The final step in forming the tube 10 is to provide an entrance and exit port into each of the end plates 12. These ports provide for the RF signal to input into and output from the tube 10. The ports can also be formed with conventional milling or EDM techniques. The finished TWT 10 can then have heat sinks 34 affixed to the heat sink surfaces 32.

Figure 7:
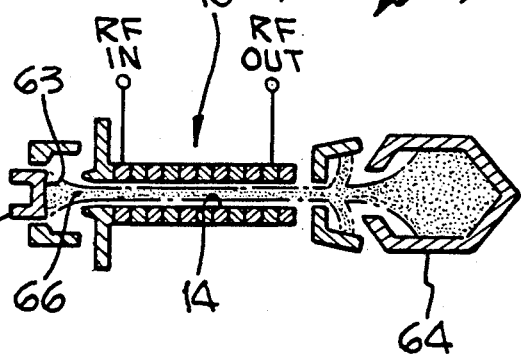
FIG. 7 is a sectional side view of an RF amplification tube assembled to an electron gun and collector.

To put the integral polepiece RF amplification tube 10 into use, the tube must be assembled with other similar circuits into a complete amplifier assembly. A matching circuit can be added to the finished coupled cavity tube 10 to match the RF impedance between the RF input port and the tube itself. The matching circuit is typically machined into a portion of the coupled cavity tube 10. The tube 10 can then be assembled with other tube sections as shown in FIG. 7, to an electron gun 62 and an electron beam collector 64. The electron gun 62 has a cathode 63 which heats up to emit electrons. The electrons are focused into a beam 66 by the magnetic field provided in the beam tunnel 14 of the tube 10. The collector 64 receives and dissipates the electrons after they exit the tube 10.

It should be apparent to those skilled in the art, that the use of an RF amplification tube having a laminate structure and generally planar surfaces would be relatively inexpensive to construct. The copper plates which form the slots provide additional thermal ruggedness, by conducting heat from the beam tunnel to the heat sink. The desired geometry for the millimeter wave frequencies can be accurately obtained without tolerance build-up.

Having thus described a preferred embodiment of a coupled cavity traveling wave tube for millimeter wave frequencies, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention. For example, other precision cutting methods, such as milling or drilling, can be utilized instead of wire EDM. As known in the art, the dimensions of the components depend upon the frequency range of the RF signal to be amplified. These dimensions can be varied dramatically to provide for alternative RF frequency signals and RF levels. Additionally, it should also be apparent that slots 24 could be provided in polepieces 16 as well as the non-magnetic plates 18, and that notches 22 could be provided in the non-magnetic plates as well as the polepieces, as desired to produce desired tube characteristics. Multiple slots 24 could also be formed in individual non-magnetic plates 18 or polepieces 16.

The present invention is further defined by the following claims.

What is claimed is:

1. An RF amplification tube for amplifying a microwave signal, comprising:

a laminate structure comprising a plurality of magnetic plates and a plurality of electrically conductive non-magnetic plates which are alternatingly and integrally formed together;

a means for inducing a magnetic field in said laminate structure having lines of flux which flow through said magnetic plates;

a planar surface provided on at least one side of said laminate structure, said planar surface permitting the attachment of a heat sink thereto; and a beam tunnel provided through said structure and permitting projection of an electron beam therethrough, said magnetic plates extending to said beam tunnel.

2. An RF amplification tube for amplifying a microwave signal, comprising:

a laminate structure comprising a plurality of magnetic plates and a plurality of electrically conductive non-magnetic plates which are alternatingly and integrally formed together;

a means for inducing a magnetic field in said laminate structure having lines of flux which flow through said magnetic plates; and a beam tunnel provided through said structure and permitting projection of an electron beam therethrough, said magnetic plates extending to said beam tunnel.

3. An RF amplification tube for amplifying a microwave signal, comprising:

a laminate structure comprising a plurality of magnetic plates and a plurality of electrically conductive non-magnetic plates which are alternatingly and integrally formed together;

a means for inducing a magnetic field in said laminate structure having liens of flux which flow through said magnetic plates;

a planar surface provided on at least one side of said laminate structure, said planar surface permitting the attachment of a heat sink thereto; and a beam tunnel provided through said structure and permitting projection of an electron beam therethrough;

wherein said non-magnetic plates each have a slot, said slots each providing a resonant cavity, said magnetic plates having a notch, said notches coupling said cavities.

4. The RF amplification tube of claim 3, wherein said beam tunnel intersects with said cavities.

5. The RF amplification tube of claim 4, wherein position of said notches in said magnetic plates alternates between a first edge and a second edge opposite to said first edge.

6. The RF amplification tube of claim 5, wherein said first edge coincides with said planar surface.

7. The RF amplification tube of claim 6, wherein said slot has a generally parallelepiped shape, and extends from said first edge to said second edge within said non-magnetic plates.

8. The RF amplification tube of claim 3, wherein position of each of said notches in said magnetic plates coincides with a first edge having said planar surface.

9. The RF amplification tube of claim 3, wherein position of a first portion of said notches in said magnetic plates coincides with said planar surface, and a second portion of said notches coincides with a second planar surface opposite to said first planar surface.

10. The RF amplification tube of claim 3, wherein each of said non-magnetic plates further comprise a pilot hole, said pilot holes aiding in formation of said slots.

11. The RF amplification tube of claim 10, wherein a first portion of said slots extend through said non-magnetic plates in a first general direction and a second portion of said slots extend through said non-magnetic plates in a second general direction which is perpendicular to said first general direction.

12. The RF amplification tube of claim 3, wherein said non-magnetic plates are formed from copper.

13. The RF amplification tube of claim 3, wherein said tube provides a coupled cavity traveling wave tube amplifier.

14. An RF amplification tube for amplifying a microwave signal, comprising:

a laminate structure comprising a plurality of magnetic plates and a plurality of electrically conductive non-magnetic plates which are alternatingly and integrally formed together;

a means for inducing a magnetic field in said laminate structure having lines of flux which flow through said magnetic plates;

a planar surface provided on at least one side of said laminate structure, said planar surface permitting the attachment of a heat sink thereto; and a heat sink attached to said planar surface, said non-magnetic plates conducting heat from said beam tunnel to said heat sink.

15. An RF amplification tube for amplifying a microwave signal, comprising:

a laminate structure comprising a plurality of magnetic plates and a plurality of electrically conductive non-magnetic plates which are alternatingly and integrally formed together;

a means for inducing a magnetic field in said laminate structure having lines of flux which flow through said magnetic plates, said inducing means comprises permanent magnets coupled to said magnetic plates; and a planar surface provided on at least one side of said laminate structure, said planar surface permitting the attachment of a heat sink thereto.

16. An RF amplification tube for amplifying a microwave signal, comprising:

a laminate structure comprising a plurality of non-magnetic plates and a plurality of electrically conductive non-magnetic plates which alternatingly and integrally formed together;

a means for inducing a magnetic field in said laminate structure having lines of flux which flow through said magnetic plates;

a planar surface provided on at least one side of said laminate structure, said planar surface permitting the attachment of a heat sink thereto;

wherein said non-magnetic plates each have at least one slot, said slots each providing a resonant cavity, a portion of said magnetic and non-magnetic plates having a notch, said notches coupling said cavities.

17. An RF amplification tube for amplifying a microwave signal, comprising:

a laminate structure comprising a plurality of non-magnetic plates and a plurality of electrically conductive non-magnetic plates which are alternatingly and integrally formed together;

a means for inducing a magnetic field in said laminate structure having lines of flux which flow through said magnetic plates;

a planar surface provided on at least one side of said laminate structure, said planar surface permitting the attachment of a heat sink thereto;

said non-magnetic plates each have at least one slot, said slots each providing a resonant cavity, a portion of said magnetic plates having a notch, said notches coupling said cavities.

18. The RF amplification tube of claim 17, wherein said tube provides klystron operation.

19. A millimeter wave electron tube, having at least a pair of coupled cavities, comprising:

an iris for coupling said coupled cavities located at an edge of a magnetic polepiece; and a planar heat sink forming a wall of said iris.

20. A millimeter wave electron tube, having at least a pair of coupled cavities, comprising:

an iris for coupling said coupled cavities located at an edge of a magnetic polepiece;

a planar heat sink forming a wall of said iris; and a plurality of non-magnetic plates, said non-magnetic plates alternatingly and integrally formed with a plurality of said polepieces.

21. The millimeter wave electron tube as claimed in claim 20, wherein each of said non-magnetic plates have a slot, said slots each providing said cavities, said magnetic plates each having a notch, said notch coupling said cavities.

22. The millimeter wave electron tube as claimed in claim 21, further comprising:

a first planar surface provided on a side of said tube, and a second planar surface provided on another side of said tube, each of said planar surfaces receiving said planar heat sink.

23. The millimeter wave electron tube as claimed in claim 22, further comprising:

a beam tunnel provided through each of said magnetic and non-magnetic plates and passing through each of said cavities, said beam tunnel permitting projection of an electron beam therethrough.

24. The millimeter wave electron tube as claimed in claim 23, wherein position of said notches in said magnetic plates alternates between a first edge coinciding with said first planar surface, and a second edge coinciding with said second planar surface.

25. The millimeter wave electron tube as claimed in claim 24, wherein position of said notches in said magnetic plates coincides with said first planar surface.

26. The millimeter wave electron tube as claimed in claim 23, wherein position of a first portion of said notches in said magnetic plates coincides with said first planar surface, and a second portion of said notches coincides with said second planar surface.

27. The millimeter wave electron tube as claimed in claim 24, wherein said non-magnetic plates are formed from copper.

28. The millimeter wave electron tube as claimed in claim 26, wherein said tube amplifies an RF microwave signal in a millimeter wavelength range.

29. A method for manufacturing an integral polepiece coupled cavity traveling wave tube for amplifying a millimeter wave RF signal, comprising the steps of:

alternatingly assembling a plurality of substantially unfinished magnetic and non-magnetic plates together;

integrally forming said plates together into a laminate structure; and forming a substantially planar surface on at least one side of said laminate structure.

30. A method for manufacturing an integral polepiece coupled cavity traveling wave tube for amplifying a millimeter wave RF signal, comprising the steps of:

alternatingly assembling a plurality of magnetic and non-magnetic plates together;

integrally forming said plates together into a laminate structure;

forming a substantially planar surface on at least one side of said laminate structure;

cutting a notch into a selected edge of selected ones of said magnetic plates and partially extending into said non-magnetic plates adjacent to said magnetic plate; and cutting a slot through each of said non-magnetic plates, each of said slots providing a cavity, said notches coupling said cavities.

31. The method for manufacturing an integral pole-piece coupled cavity traveling wave tube of claim 30, wherein said selected edge alternates between a first side of said stack and a second side which is opposite to said first side.

32. The method for manufacturing a coupled cavity traveling wave tube of claim 31, wherein said plates further comprise:

a guide hole provided through each of said plates;

wherein said step of alternatingly assembling said plates further comprises engaging each of said guide holes with a single moly tube.

33. The method for manufacturing a coupled cavity traveling wave tube of claim 32, wherein said non-magnetic plates further comprise:

a pilot hole extending between said first side and second side;

wherein said step of cutting a slot further comprises using said pilot hole as a cutting initiation point.

34. The method for manufacturing a coupled cavity traveling wave tube of claim 33, wherein said laminate structure further comprises:

a first planar surface provided on said first side, and a second planar surface provided on said second side, each of said planar surfaces receiving a planar heat sink.

35. The method for manufacturing a coupled cavity traveling wave tube of claim 33, wherein said non-magnetic plates are formed from copper.

* * * * *